US007476183B1

(12) United States Patent
Chrest

(10) Patent No.: US 7,476,183 B1
(45) Date of Patent: Jan. 13, 2009

(54) WEIGHT LIFTING APPARATUS

(76) Inventor: Daniel E. Chrest, 4521 Roosevelt Ave. NE., Canton, OH (US) 44705

( * ) Notice: Subject to any disclaimer, the term of this patent is extended or adjusted under 35 U.S.C. 154(b) by 395 days.

(21) Appl. No.: 11/259,904

(22) Filed: Oct. 28, 2005

(51) Int. Cl.
*A63B 23/16* (2006.01)

(52) U.S. Cl. ..... 482/93; 482/908

(58) Field of Classification Search ..... 482/94, 482/106, 50, 93, 97, 908, 100, 137, 136, 482/49, 40, 83; D21/673, 675, 679, 689
See application file for complete search history.

(56) References Cited

U.S. PATENT DOCUMENTS

| | | | | | |
|---|---|---|---|---|---|
| 588,350 | A * | 8/1897 | Perkins | 482/109 |
| 3,690,655 | A * | 9/1972 | Chapman | 482/109 |
| 4,252,316 | A | 2/1981 | Price | |
| 4,312,506 | A | 1/1982 | Brennan | |
| 4,537,394 | A * | 8/1985 | Golinsky, Jr. | 482/109 |
| 4,641,836 | A | 2/1987 | Clifton | |
| 4,872,667 | A | 10/1989 | Favot | |
| 4,913,421 | A * | 4/1990 | Bachman | 482/93 |
| 5,042,799 | A | 8/1991 | Stanley | |
| 5,207,624 | A * | 5/1993 | Paskovich | 482/93 |
| D397,174 | S | 8/1998 | Sandoval | |
| D418,558 | S | 1/2000 | Sandoval | |
| 6,152,858 | A * | 11/2000 | Kolb | 482/44 |
| 6,305,051 | B1 * | 10/2001 | Cho | 16/430 |
| 6,689,022 | B1 * | 2/2004 | Emick | 482/93 |
| 7,137,930 | B1 * | 11/2006 | Carr | 482/98 |
| 2004/0063553 | A1 * | 4/2004 | Viscount | 482/107 |

* cited by examiner

*Primary Examiner*—Lori Amerson
*Assistant Examiner*—Sundhara M Ganesan

(57) ABSTRACT

A weight lifting apparatus that varies the angle and resistance of weights applied to upper body exercises. The apparatus comprises a T-handle at an upper end with a junction block at the lower end. The junction block further comprises ears between which fit a swivel of a weight post that removably receives Olympic style plate weights. The swivel and ears are fitted with keyways into which removably fits a retention shaft with keys, thereby providing for adjustment of the angle of the weight post. A further embodiment features a single hand grip and interchangeability of handles.

2 Claims, 3 Drawing Sheets

WEIGHT LIFTING APPARATUS

BACKGROUND OF THE INVENTION

1. Field of the Invention

This invention relates to weight lifting devices and more specifically to a weight lifting apparatus that is used for strengthening and conditioning arms and upper body.

Many devices have been developed that aid in lifting weights by changing the effects imposed by gravity upon the weight to be lifted. These devices provide for various methods of imposing a weight against human body part movements. The current invention imposes weight resistance in a fashion differently from those devices previously introduced.

2. Description of the Prior Art

Several devices for upper body weight resistance application are taught in the prior art. By way of example:

U.S. Pat. No. 4,641,836 issued to Clifton on Feb. 10, 1987 discloses a device designed for performing triceps exercises only, and, as such, not only differs in design but is far more limited than the present invention.

U.S. Pat. No. 4,872,667 issued to Favot on Oct. 10, 1989 discloses a device for increasing a weight's leverage against a user during part of a range of movement of an exercise. While the device is useful in its application, it is unlike the present invention.

U.S. Pat. No. 4,312,506 issued to Brennan on Jan. 16, 1982 discloses a device to limit hand and arm movements often affected by a user when performing a barbell curl. While the device is no doubt useful for that purpose, it does not offer the multi-use advantages of the present invention.

While the above-described devices fulfill their respective and particular objects and requirements, they do not describe a weight lifting apparatus that provides for the advantages of the present invention, therefore, a need exists for an improved weight lifting apparatus, particularly one that aids in properly imposing weighted resistance to movement against an individual's upper body parts.

In this respect, the present invention substantially departs from the conventional concepts and designs of the prior art.

SUMMARY OF THE INVENTION

In view of the foregoing disadvantages inherent in the known types of weight lifting apparatuses now present in the prior art, the weight lifting apparatus overcomes the above-mentioned disadvantages and drawbacks of the prior art. As such, the general purpose of the weight lifting apparatus, described subsequently in greater detail, is to provide a weight lifting apparatus which has all of the advantages of the prior art mentioned heretofore and many novel features that result in an improved weight lifting apparatus which is not anticipated, rendered obvious, suggested, or even implied by the prior art, either alone or in combination thereof.

To accomplish this, the weight lifting apparatus is comprised of an upright bar with a T-handle at the top end. The T-handle is preferably comprised of knurled handles at the outer ends of the horizontal of the T. Grip stops are fitted inwardly from the handles. In further embodiments, knurling is also executed on inner faces of T-handle to accommodate narrower grip of the T-handle. An additional embodiment features a removable T-handle that is replaced by a single hand grip for performing single-handed exercises. A junction block at the bottom of the upright is fitted with a weight post with weight plate for removably receiving weights. The post is at about a 45 degree angle from the vertical, away from the upright.

In the preferred embodiment, the junction block at the bottom of the upright comprises ears that extend a horizontal length from the block. The ears are spaced about 2 inches apart in the preferred embodiment. Further embodiments space the ears anywhere from about 1 to 3 inches apart. The weight post has a pin orifice at an upper end for removably receiving a pin that retains weights that are place upon the post. A lower region of the post is affixed with a weight plate for receiving the weights. Below the weight plate is a swivel for slideably and pivotally fitting between the block ears of the junction block. A swivel flange strengthens the junction of the post and swivel. The post is preferably sized at slightly less than 2 inches in diameter in order to hold Olympic weights of about 2 inch diameter holes. Preferably, adjustability is accomplished with keyways within ears of the junction block. The plurality of keyways is perpendicular to the length of the ears that extend horizontally from the junction of the junction block and the upright. Keyways are identically within the swivel. A retention shaft is slideably and removably fitted into the ears and swivel. The shaft has keys that fit within the keyways when the keyways are aligned. This fitment locks the weight post at a chosen angle for a user. A shaft cap with a rod fits into a receiving hole at an end of the shaft opposite its cap. The rod is fitted with a detent ball and the receiving hole is fitted with a groove for removably receiving the detent ball. This selectively retains the shaft and a cap, thereby securing the chosen weight post angle.

The invention offers greater latitude in applying weighted resistance against upper body parts. As weights are placed at a distance from the vertical upright, the angle of attack on a particular muscle group being exercise can be varied. This variation capability is important for several reasons in several exercises.

An arm curl, for example, performed with the invention places a different and varied load on the biceps as the curl progresses toward full contraction of that muscle group. Additionally, as example, a triceps contraction exercise is often performed either while a user is lying flat on his/her back. Arms are positioned vertically and a weight is grasped. Arms are then bent at the elbow, then re-straightened. The weight moves up and down. The invention provides an angle by which the weight can be either pointed away from a user or toward a user. Both positions vary the angle of the dangled weight and therefore the force applied. This same exercise for example, may also be performed in a standing position. Additionally, front deltoid raises are better performed with the invention and the angles of weighted attachments provided therefrom. Further exercises that may gain advantage in movement and resistance application include those such as lateral deltoid raises, rows, seated bicep curls, dangling arm curls, bent rows, and more. The numbers of exercises that gain an advantage from the use of the invention are limited only by imagination of a user.

The invention is offered in various embodiments which include such features as plastic coated handles, pivoting handles, and even a rest rack for holding the invention when not in use or during weight loading and unloading. The invention is easily utilized by beginners and professionals alike.

Thus has been broadly outlined the more important features of the weight lifting apparatus so that the detailed description thereof that follows may be better understood and in order that the present contribution to the art may be better appreciated.

Numerous objects, features and advantages of the weight lifting apparatus will be readily apparent to those of ordinary skill in the art upon reading the following detailed description of presently preferred, but nonetheless illustrative, embodiments of the weight lifting apparatus when taken in conjunction with the accompanying drawings. In this respect, before explaining the current embodiments of the weight lifting apparatus in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the weight lifting apparatus. It is therefore important that the claims be regarded as including such equivalent constructions insofar as they do not depart from the spirit and scope of the present invention.

Objects of the weight lifting apparatus, along with various novel features that characterize the invention are particularly pointed out in the claims forming a part of this disclosure. For better understanding of the weight lifting apparatus, its operating advantages and specific objects attained by its uses, refer to the accompanying drawings and description.

DETAILED DESCRIPTION OF THE PREFERRED EMBODIMENT

With reference now to the drawings, and in particular FIGS. 1-4 thereof, the preferred embodiment of the weight lifting apparatus employing the principles and concepts of the present invention and generally designated by the reference number 10 will be described.

Figure 1:
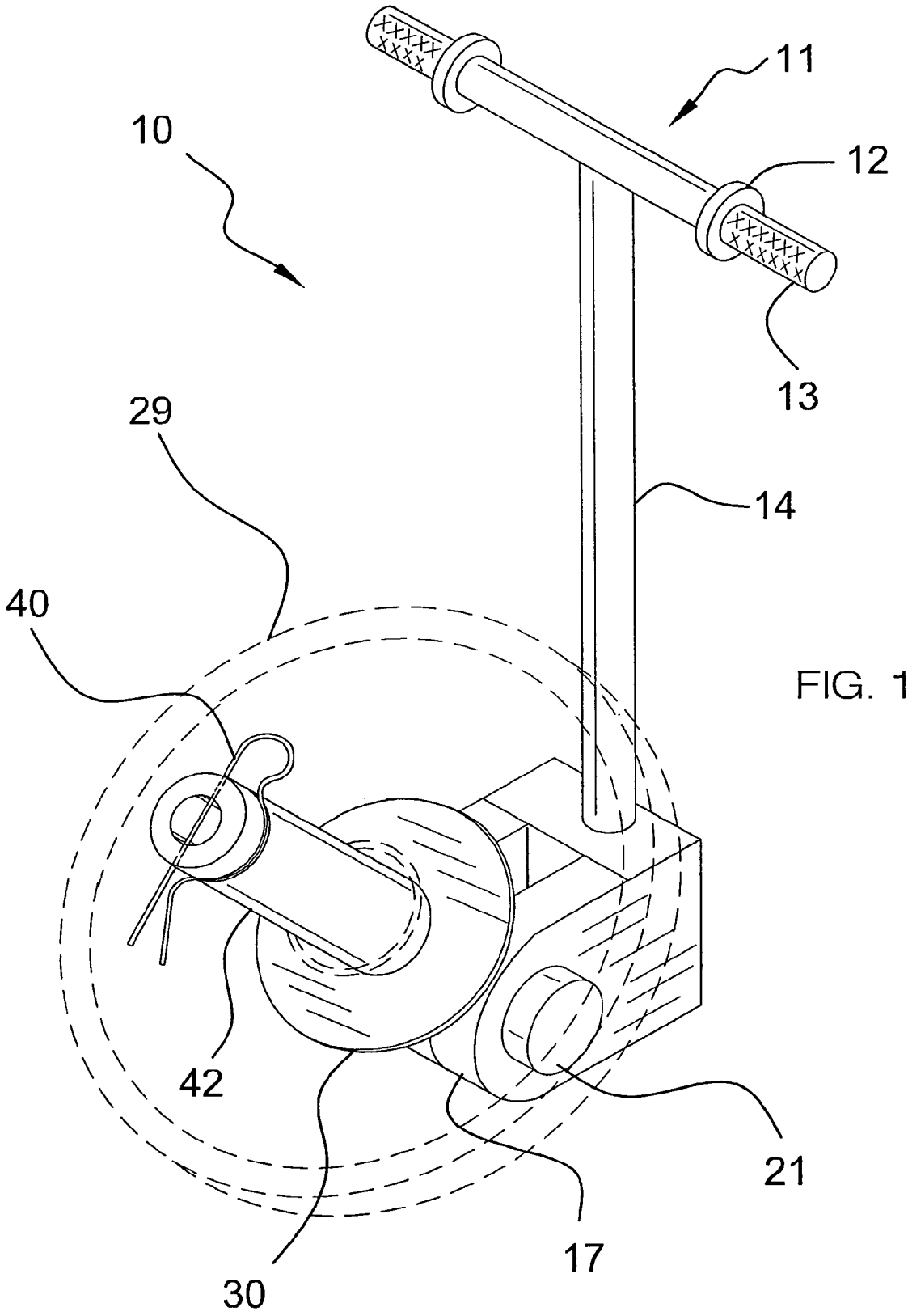
FIG. 1 is a perspective view of the weight lifting apparatus.

Referring to FIG. 1, the invention 10 comprises vertical upright 14 with T-handle 11 at upper end and junction block 16 at lower end. T-handle 11 is further comprised of grip stops 12 disposed outwardly and adjacent to knurled handles 13. Junction block 16 is further comprised of block ears 17 projecting horizontally from block 16. Block ears 17 are spaced apart by about 2 inches. Weight post 42 projects at an angle from vertical from block ears 17. Weight plate 30 is rigidly affixed to a lower region of weight post 42 and is a rest for a weight 29. Pin 40 removably inserts into the top region of post 42 and is a stop against a weight 29 falling off.

Figure 2:
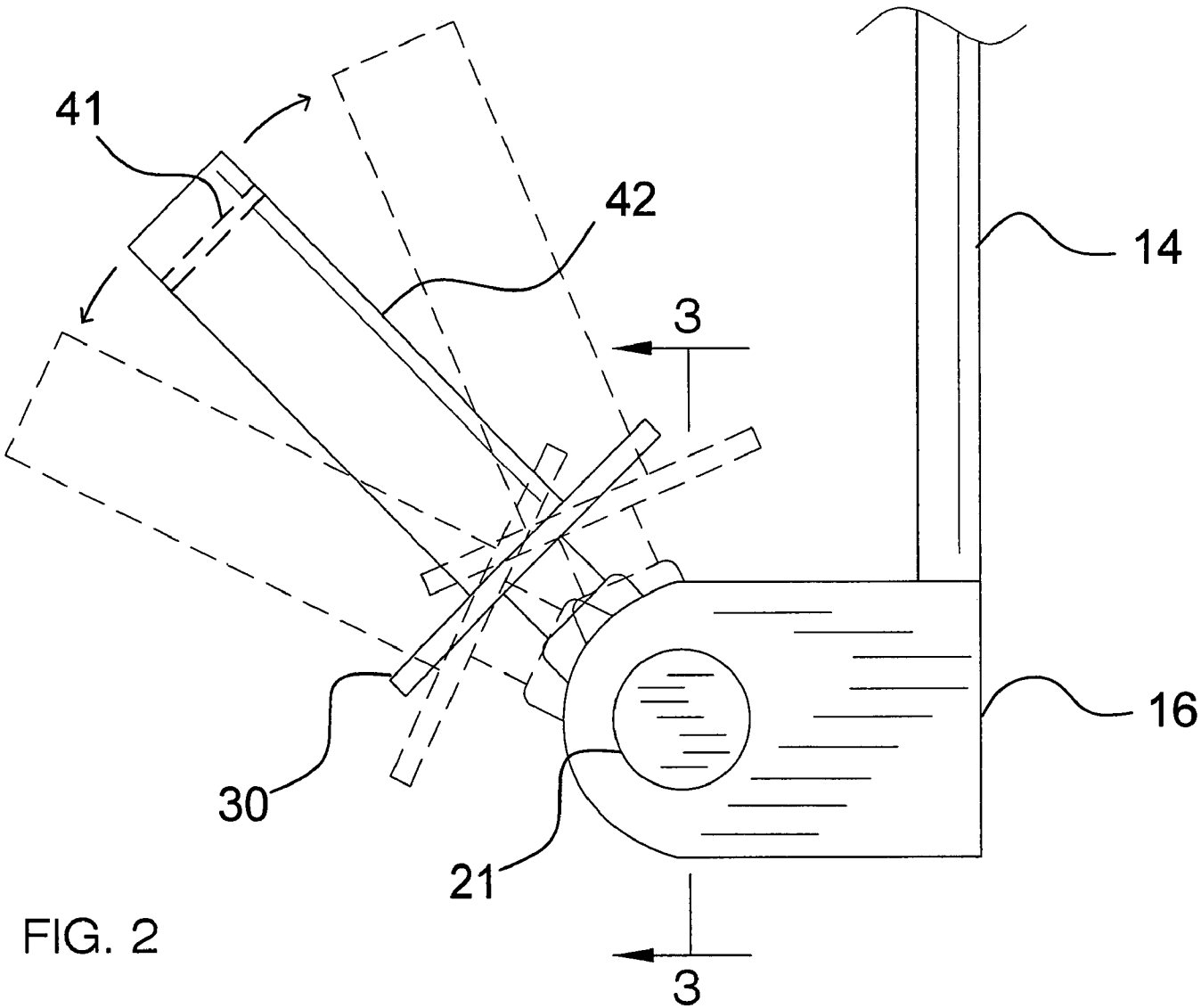
FIG. 2 is a lateral view of the weight lifting apparatus illustrating the swivel locating potential of the weight post.

Referring to FIG. 2, potential movement of weight post 42 is illustrated. Pin orifice 41 is in upper end of post 42. Pin orifice removably receives pin 40 (FIG. 1).

Figure 4:
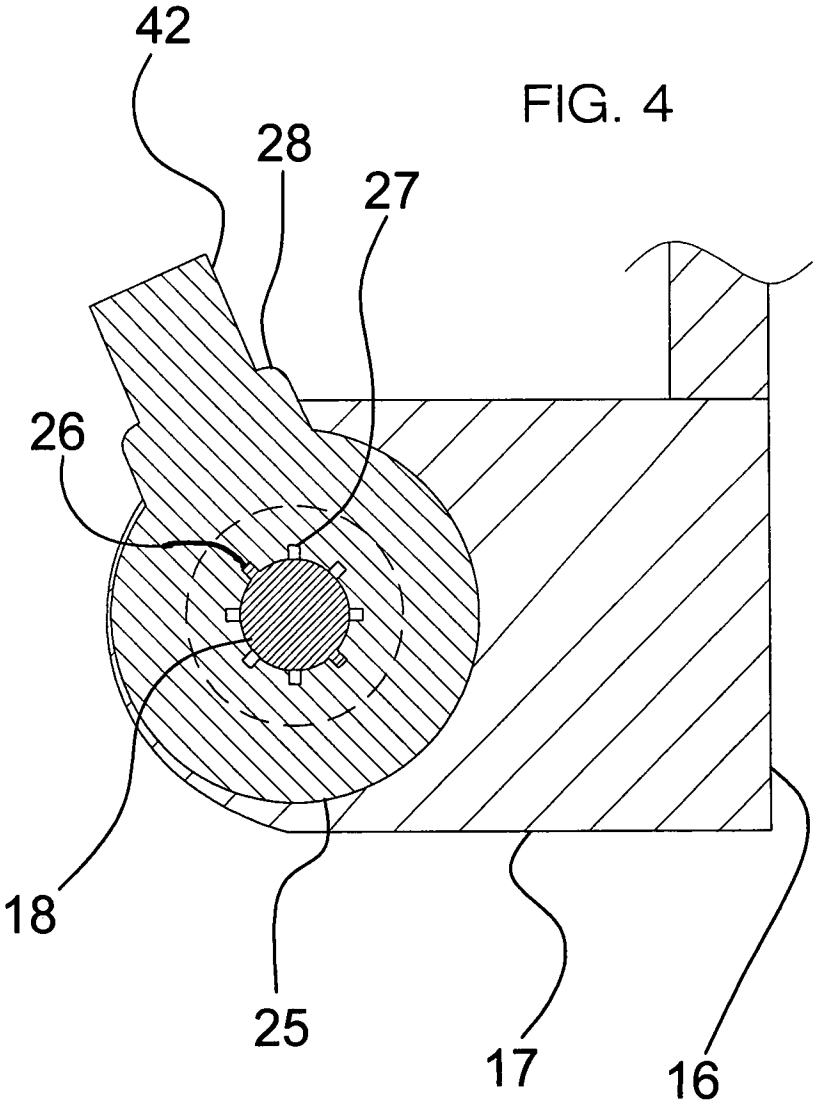
FIG. 4 is a lateral cross sectional view of the weight post swivel and a junction block ear illustrating the swivel and ear keyways engaged by the retention shaft keys.
Figure 3:
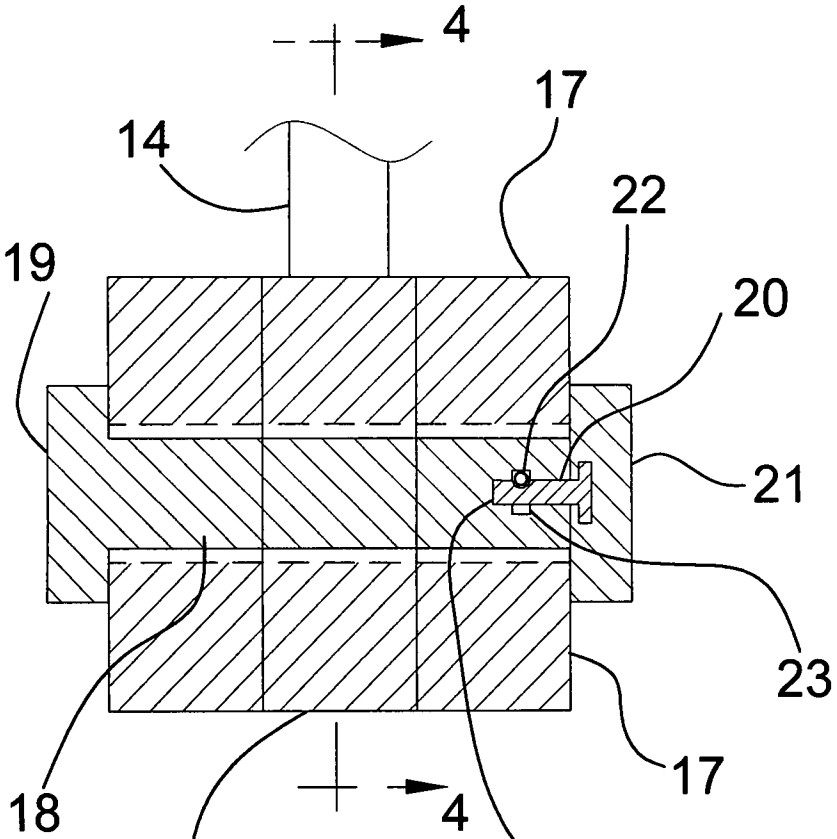
FIG. 3 is a top cross sectional view of the retention shaft and shaft cap with shaft rod fitted through the junction block ears and the weight post swivel.

Referring to FIGS. 3 & 4, junction block ears 17 extended horizontally from junction block 16. Swivel 25 is at lower end of weight post 42. Swivel flange 28 adds strength to the union of weight post 42 and swivel 25. Swivel 25 slideably and pivotally resides between ears 17. Ears 17 and swivel 25 further comprise identical keyways 27. Keyways 27 are perpendicular to the horizontal length of shaft ears 17. Retention shaft 18 is slideably fitted within ears 17 and swivel 25. Longitudinal shaft keys 26 extend the length of shaft 18 and slideably and removably fit keyways 17. Shaft head 19 abuts one ear 17 of junction block 16. Shaft cap 21 if further comprised of shaft rod 20 removably inserting into receiving hole 31 of shaft 18. Rod 20 is further comprised of detent ball 22. Receiving hole 31 is further comprised of ball groove 23 removably receiving detent ball 22 such that shaft cap 21 selectively retains retention shaft 18.

A user (not shown) removes cap 21 from shaft 18. Retention shaft 18 is then removed from ears 17 and swivel 25. Swivel 25 is rotated to a desired position relative to the angle of intersection of weight post 42 with block 16. At a desired position, user inserts shaft 18 such that keyways of ears 17 and swivel 25 align.

Shaft 18 is re-inserted into ears 17 and swivel 25, thereby locking the desired angle. Shaft cap 21 is re-installed against ear 17 with detent ball 22 of rod 20 inserting into groove 23 of hole 31, thereby selectively retaining cap 21. Weights 29 of desired mass are slideably fitted onto post 42. Pin 40 is selectively inserted into orifice 41 to ensure that weights 29 do not fall off during utilization of invention 10. A user then performs desired exercisers. Removal of weights 29 is a reverse procedure of slideable installation. Adjustment of angle between weight post 42 and block 16 is performed as above. Further desired exercises are performed or invention 10 is placed back onto a rest rack (not shown).

With respect to the above description then, it is to be realized that the optimum dimensional relationships for the parts of the weight lifting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A weight lifting apparatus for use with typical plate weights, the apparatus comprising:

an upright with a T-handle on an upper end and a junction block on an opposite end, the junction block further comprising a weight post exiting the junction block at an angle greater than 10 degrees but less than 90 degrees from vertical, the weight post sized to removably receive typical weight plates;

a pin orifice disposed perpendicularly in an upper end of the weight post;

a pin removably inserting into the pin orifice, thereby removably retaining the weight plates;

wherein the weight post exit angle from the junction block is adjustable;

wherein the T-handle is further comprised of knurled ends thereby aiding a user's grasp of the handle;

wherein the T-handle is further comprised of swivel handles whereby the outer handles held by a user pivot about the T-handle, thereby allowing a free moving Pendulum of the upright, T-handle and junction block;

wherein the T-handle is removably replaceable by a single handle at the center of the upper end of the upright;

wherein the T-handle is further comprised of grip stops disposed inwardly from the knurled ends;

wherein the junction block further comprises opposing block ears, each block ear disposed horizontally from the junction block and having a length away from the block, the block ears spaced apart by about 1-3 inches, the block ears further comprising holes with at least 6 keyways, the holes and keyways at a perpendicular to a horizontal length of the block ears;

the weight post further comprising, at an end opposite the upper end, a round swivel slideably fitting between the block ears, the swivel further comprising shaft keyways identical to the block ear keyways;

a retention shaft with a shaft head on one end and opposing shaft keys disposed along a length of the shaft, the keys removably engaging the keyways of the block ears and the weight post, the retention shaft further comprising a receiving hole in an end opposite the shaft head, the receiving hole with ball groove disposed inwardly and throughout a circumference of the hole;

a shaft cap with a shaft rod extending perpendicular to a circumference of the shaft cap, the shaft rod further comprising a detent ball, the shaft rod removably received within the retention shaft receiving hole and the ball groove of the shaft receiving hole removably receiving the ball detent of the shaft rod.

2. A weight lifting apparatus for use with typical plate weights, the apparatus comprising:

an upright with a T-handle on an upper end and a junction block on an opposite end, the T-handle further comprising swivel handles with knurled ends, the T-handle further comprising grip stops disposed inwardly from the swivel handles, the junction block further comprising opposing block ears, each block ear disposed horizontally from the junction block and having a length away from the block, the block ears spaced apart by about 1-3 inches, the block ears further comprising holes with at least 6 keyways, the holes and keyways perpendicular to the length of the block ears;

a weight post further comprising, at an end opposite the upper end, a round swivel slideably fitting between the block ears, the swivel further comprising shaft keyways identical to the block ear keyways;

a retention shaft with a shaft head on one end and opposing shaft keys disposed along a length of the shaft, the keys removably engaging the keyways of the block ears and the weight post, the retention shaft further comprising a receiving hole in an end opposite the shaft head, the receiving hole with ball groove disposed inwardly and throughout a circumference of the hole;

a shaft cap with a shaft rod extending perpendicular to a circumference of the shaft cap, the shaft rod further comprising a detent ball, the shaft rod removably received within the retention shaft receiving hole and the ball groove of the shaft receiving hole removably receiving the ball detent of the shaft rod;

a pin orifice disposed perpendicularly in an upper end of the weight post;

a pin for removably inserting into the pin orifice, thereby removably retaining the weight plates.

* * * * *